US009205285B2

(12) United States Patent
Jones et al.

(10) Patent No.: US 9,205,285 B2
(45) Date of Patent: Dec. 8, 2015

(54) RESCUE DESCENDER SYSTEM

(75) Inventors: Owain Jones, Chippenham (GB); Karl Jones, Devizes (GB)

(73) Assignee: Latchways PLC, Wiltshire (GB)

( * ) Notice: Subject to any disclaimer, the term of this patent is extended or adjusted under 35 U.S.C. 154(b) by 0 days.

(21) Appl. No.: 13/988,944

(22) PCT Filed: Nov. 18, 2011

(86) PCT No.: PCT/GB2011/052253

§ 371 (c)(1),
(2), (4) Date: Oct. 16, 2013

(87) PCT Pub. No.: WO2012/066342

PCT Pub. Date: May 24, 2012

(65) Prior Publication Data

US 2014/0041960 A1 Feb. 13, 2014

(30) Foreign Application Priority Data

Nov. 18, 2010 (GB) ..... 1019462.9
Jul. 18, 2011 (GB) ..... 1112332.0

(51) Int. Cl.

| | |
|---|---|
| ***A47L 3/04*** | (2006.01) |
| ***A62B 1/16*** | (2006.01) |
| ***A62B 35/00*** | (2006.01) |
| ***A63B 29/02*** | (2006.01) |
| ***E06C 7/18*** | (2006.01) |
| ***A62B 1/14*** | (2006.01) |
| ***A62B 1/10*** | (2006.01) |

(52) U.S. Cl.
CPC .... *A62B 1/14* (2013.01); *A62B 1/10* (2013.01)

(58) Field of Classification Search
CPC .... A62B 35/00; A62B 35/04; A62B 35/0093; A62B 1/00; A62B 1/06; A62B 1/08; A62B 1/10; A62B 1/14
USPC ..... 182/231, 235, 71, 72, 73, 236, 240, 5, 182/3, 232, 237, 241, 192; 188/65.2, 65.4, 188/65.5
See application file for complete search history.

(56) References Cited

U.S. PATENT DOCUMENTS

| | | | | | |
|---|---|---|---|---|---|
| 876,840 | A | * | 1/1908 | Reuter | 182/3 |
| 4,145,027 | A | * | 3/1979 | Brimo | 182/193 |
| 4,171,795 | A | * | 10/1979 | Bianchi | 182/236 |
| 4,253,218 | A | | 3/1981 | Gibbs | |
| 4,311,218 | A | * | 1/1982 | Steffen | 188/65.4 |
| 4,437,546 | A | | 3/1984 | Marinoff | |
| 4,506,760 | A | * | 3/1985 | Baker et al. | 182/5 |

(Continued)

FOREIGN PATENT DOCUMENTS

| | | | |
|---|---|---|---|
| GB | 2414005 | A | 11/2005 |
| WO | WO2009027619 | A1 | 3/2009 |

*Primary Examiner* — Katherine Mitchell
*Assistant Examiner* — Shiref Mekhaeil
(74) *Attorney, Agent, or Firm* — Gordon & Jacobson, P.C.

(57) ABSTRACT

A descender device, typically for use in a fall arrest system, for enables a suspended body to be lowered, and includes a descent line and a release element to be actuated by a person. The release element is arranged in a restraint configuration to inhibit the descent line from being deployed and in a release configuration to permit the descent line to be deployed. A restraint arrangement is arranged prior to deployment of the descent line, to clamp or pinch a length of flexible line thereby to inhibit deployment of the descent line, the restraint arrangement being reconfigurable upon release of the release element to permit the descent line to be deployed.

22 Claims, 15 Drawing Sheets

(56) References Cited

U.S. PATENT DOCUMENTS

| | | | | | |
|---|---|---|---|---|---|
| 4,576,248 | A * | 3/1986 | Marom | 182/5 |
| 4,938,435 | A * | 7/1990 | Varner et al. | 244/142 |
| 5,145,036 | A * | 9/1992 | Omalia | 188/65.5 |
| 5,379,858 | A * | 1/1995 | Sandoval | 182/7 |
| 5,850,890 | A * | 12/1998 | Couttet | 182/5 |
| 5,924,522 | A * | 7/1999 | Ostrobrod | 182/191 |
| 5,927,438 | A * | 7/1999 | Ostrobrod | 182/241 |
| 6,029,777 | A * | 2/2000 | Rogelja | 182/193 |
| 6,446,753 | B1 * | 9/2002 | Novak | 182/193 |
| 8,495,800 | B2 * | 7/2013 | Lipke | 24/115 R |
| 8,794,392 | B2 * | 8/2014 | Kowatsch | 188/65.2 |
| 2006/0113147 | A1 | 6/2006 | Harris, Jr. | |
| 2007/0261921 | A1 * | 11/2007 | Gal et al. | 182/233 |
| 2009/0084631 | A1 | 4/2009 | Casebolt | |
| 2009/0173578 | A1 * | 7/2009 | Renton et al. | 182/235 |
| 2010/0122874 | A1 | 5/2010 | Harris | |
| 2010/0163338 | A1 * | 7/2010 | Wood | 182/6 |
| 2010/0252366 | A1 * | 10/2010 | Jones et al. | 182/232 |
| 2010/0282541 | A1 * | 11/2010 | Renton et al. | 182/234 |
| 2012/0285770 | A1 * | 11/2012 | Auston et al. | 182/5 |
| 2013/0299275 | A1 * | 11/2013 | Westermann et al. | 182/3 |

* cited by examiner

RESCUE DESCENDER SYSTEM

CROSS-REFERENCE TO RELATED APPLICATIONS

This application claims priority from PCT/GB/2011/052253 filed on Nov. 18, 2011, GB 1019462.9 filed on Nov. 18, 2010, and GB 1112332.0 filed on Jul. 18, 2011, all of which are hereby incorporated by reference in their entireties.

BACKGROUND OF THE INVENTION

1. Field of the Invention

The present invention relates to a rescue descender system primarily, but not exclusively for use in fall arrest or fall safety systems for personnel safety when working at height.

2. State of the Art

Fall arrest or fall safety systems are known in which personnel working at height are secured to a safety line in order to arrest a fall, should this occur. Such safety lines can comprise a self retracting lifeline which includes a safety block secured to an anchor point and a safety line which pays out as the user moves away from the safety block. A brake device engages to prevent paying out of the safety line in the event of a fall. Typically the system includes an energy absorption device arranged to absorb the energy of the fall when the line payout stops in order to arrest the fall.

Typically, in the circumstances of a fall, the user can be left suspended in mid air. In order to be rescued, the user can be hooked from above by a rescuer (if in reach and accessible), or a rescuer can descend to the individual to attach them to a rescue line. Alternatively, devices have been proposed to enable a suspended user to self instigate lowering to ground or rescue level. Such arrangements are disclosed in, for example, GB2414005 and WO2009/027619. Such systems can be referred to as self rescue devices.

GB2414005 discloses a rescue descender system comprising a casing, which incorporates a bracket for attachment to a person's body harness whereby the bracket can be releasably attached to a load element attached to a safety line and the safety line may then be attached to a secure anchorage. Various release mechanisms are disclosed including release that is initiated remotely such as by the transmission and receipt of radio signals. The receipt of radio signals may be used to initiate the activation of an actuator that can then carry out the release operation. An example given of a typical actuator is a pyrotechnic actuator (explosive squib) that is initiated electrically. When the load element is released from the bracket, elongate that is also attached to the load element is deployed at a speed controlled by a speed control means thereby controlling the descent of the person being rescued.

When a person is arrested after a fall, loads of up to 6 kN can be applied between the harness and safety line WO2009/027 length of descent line 619 discloses methods of attaching the rescue apparatus to a harness in normal use whereby the weight of the rescue apparatus is supported at least in part by alternative means other than the rigid load elements described in GB2414005.

In both documents identified, the prior art systems described use a descent line that is payed out from the descent reel is connected to the safety line by a load element and a release means actuated to permit release of the load element to allow paying out of the descent line from the descent line reel or store. In both prior art arrangements the full load of the fall and the suspended user is passed via the release means. This results in a high force necessary to effect release of the release means. Hence in WO2009/027619 the invention utilises detonation of an explosive squib as an exemplary release means for releasing the release pin 15.

SUMMARY OF THE INVENTION

An improved arrangement has now been devised.

According to a first aspect, the present invention provides a descender device for enabling a suspended body to be lowered, the descender device comprising:

a descent line, a release element to be actuated by a person, the release element arranged in a restraint configuration to inhibit the descent line from being deployed and in a release configuration to permit the descent line to be deployed; wherein, a restraint arrangement is arranged prior to deployment of the descent line, to clamp or pinch a length of flexible line thereby to inhibit deployment of the descent line, the restraint arrangement being reconfigurable upon release of the release element to permit the descent line to be deployed.

The descent line may in use connected (either directly or by means of an intermediate line or lines or connectors) to a lifeline device such as a self retracting lifeline of a safety block. Connection loops, rings and/or karabiners may be provided for this purpose.

It is preferred that the release element is connected to a pull tether, which pull tether extends over a shoulder portion of a harness.

In one embodiment, it is preferred that the release element secures through a loop or ring, which loop or ring is attached to a flexible line.

In one embodiment, the release element may secure through a loop or ring formed in, or connected to, the descent line or a length of separate line, such as a binding line (which separate/binding line is typically connected to the descent line).

In one embodiment the release element may comprise a pin extending through the loop or ring, the loop or ring preferably being pulled off over the end of the pin when moving to the release configuration.

In one embodiment, the release element is preferably connected to a pull tether, which pull tether has a finger pull portion to be gripped by a user, and in addition to the finger pull portion, a second pull formation.

It may be preferred that the second pull formation is in use positioned adjacent the shoulder, torso or back of a user. This provides for ease of remote access to pull the tether by means of the second pull formation.

The second pull formation may comprise a loop or ring, preferably a rigid or semi rigid form, secured with respect to the pull tether and arranged to stand proud of the user when the device is mounted (typically by harness) to the user.

In a preferred embodiment the restraint arrangement comprises a clamp arrangement which is arranged to clamp or pinch a binding portion of the descent line and/or a length of separate binding line (which binding line is typically connected to the descent line).

Preferably, the binding portion, or binding line is clamped or pinched at one or more points intermediate the opposed ends of the line and spaced from the release element.

It may be preferred that movement of the release element to the release configuration permits (or causes) the restraint arrangement to reconfigure from the clamping position, to permit the line to pass.

In a preferred embodiment, the restraint arrangement comprises a plurality of spaced bars (pinch bars), the flexible line (for example the descent line and/or a binding line) preferably passing serpentine-wise through the bars.

It is preferred that the spacing of the bars on the rack can reduce to clamp or pinch the flexible line between the bars or expand to permit the line to pass via the bars in the rack.

Beneficially, moving of the release element to the release configuration permits or causes the spacing between the bars on the rack to increase from the reduced spacing configuration.

It is preferred that the flexible line (the descent line and/or a separate binding line) is secured relative to the release element in the restraint configuration to inhibit the descent line from being deployed and released from the release element in a release configuration, in order to permit the descent line to be deployed.

In one embodiment the binding line and the descent line are configured to both extend through the clamping arrangement before deployment of the release line.

In such an embodiment it is a preferred consequence that the descent line and the binding line are arranged to be drawn through the clamping arrangement in unison (preferably side by side) when the descent line is deployed.

The binding line and the descent line may beneficially be connected to one another (typically at a connector ring) at a position downstream deployment-wise of the clamping arrangement.

In certain embodiments, the release means may comprise a pin.

It is preferred that, when actuated to permit the descent line to be deployed the release element is forced to rupture or break a capture element (such as for example a breakable clip) securing the release element in the restraint configuration.

It is preferred that the descent line is stored on-board the descender device.

The descent line is preferably wound on a reel pending deployment.

The device preferably includes a brake arrangement to limit the deployment rate of the descender line.

According to a second aspect, the invention provides a descender device for enabling a suspended body to be lowered, the descender device comprising:

a descent line, a release element to be actuated by a person, the release element arranged in a restraint configuration to inhibit the descent line from being deployed and in a release configuration to permit the descent line to be deployed; wherein, the release element is connected to a pull tether, which pull tether extends in a harness over a shoulder portion of the harness.

According to a further aspect, the invention provides descender device for enabling a suspended body to be lowered, the descender device comprising:

a descent line, a release element to be actuated by a person, the release element arranged in a restraint configuration to inhibit the descent line from being deployed and in a release configuration to permit the descent line to be deployed;

wherein, the release element secures through a loop or ring, which loop or ring is attached to a flexible line.

It is preferred that the release element comprises a pin extending through the loop or ring.

According to a further aspect, the invention provides a descender device for enabling a suspended body to be lowered, the descender device comprising:

a descent line, a release element to be actuated by a person, the release element arranged in a restraint configuration to inhibit the descent line from being deployed and in a release configuration to permit the descent line to be deployed; wherein, the release element is connected to a pull tether, which pull tether has a finger pull portion to be gripped by a user, and also spaced from the finger pull portion and a second pull formation.

The features described as preferred or optional in respect of the first aspect may also be considered preferred or optional features of the further aspects of the invention.

According to a further aspect, the invention provides a descender system for enabling a suspended body to be lowered, the descender system comprising:

a descent line, a descender device provided with a release element arranged in a restraint configuration to inhibit the descent line from being deployed and in a release configuration to permit the descent line to be deployed, wherein:

i) the descender device includes a load member movable between a first position in which the release element is restrained to be held in the restraint configuration and a second position in which the release element can be moved to the release configuration; and/or, ii) the descender device includes a clamp arrangement arranged prior to deployment of the descent line, to clamp or pinch the descent line, or a length of line connected to the descent line, at one or more points intermediate the opposed ends of the line and spaced from the release means, the clamp arrangement being reconfigurable to permit the line to pass; and/or;

iii) the load of the suspended body imparted to the descender device is not transmitted primarily via the release element the load on the release element is substantially independent of the load imparted by the suspended body.

In accordance with the invention, the descent line can extend completely through the descender device as a unitary line or can be comprised of a plurality of connected lines tethers or webs. The descent line is in use connected (either directly or by means of an intermediate line or lines) to a lifeline device such as a self retracting lifeline of a safety block. Connection loops and/or karabiners may be provided for this purpose.

It is preferred that the load member is normally biased to the first position. This may be achieved by a spring element.

It is preferred that the load member is moved to the second position when a load is applied to the load member as a result of the person becoming suspended in a fall arrest event. This means that the load member moves effectively automatically to the second position when the person becomes suspended.

The load member preferably has an abutment portion which moves with the load member (and may in fact comprise a portion of the load member), the abutment portion abutting, engaging or otherwise blocking the release element in the first position (thereby preventing movement of the release element from the restraint configuration), and being removed from abutment or engagement with the release element in the second position (thereby permitting movement of the release element from the restraint configuration).

In a preferred embodiment, the load element is movable pivotably (or rotatably) between the first and second position.

It is preferred that the load element is arranged for attachment to a user wearable harness.

According to a further aspect, the present invention provides a fall arrest system incorporating a descender system as defined herein.

The invention will now be further described, by way of example only, and with reference to the accompanying drawings.

DETAILED DESCRIPTION OF THE PREFERRED EMBODIMENTS

Figure 1A:
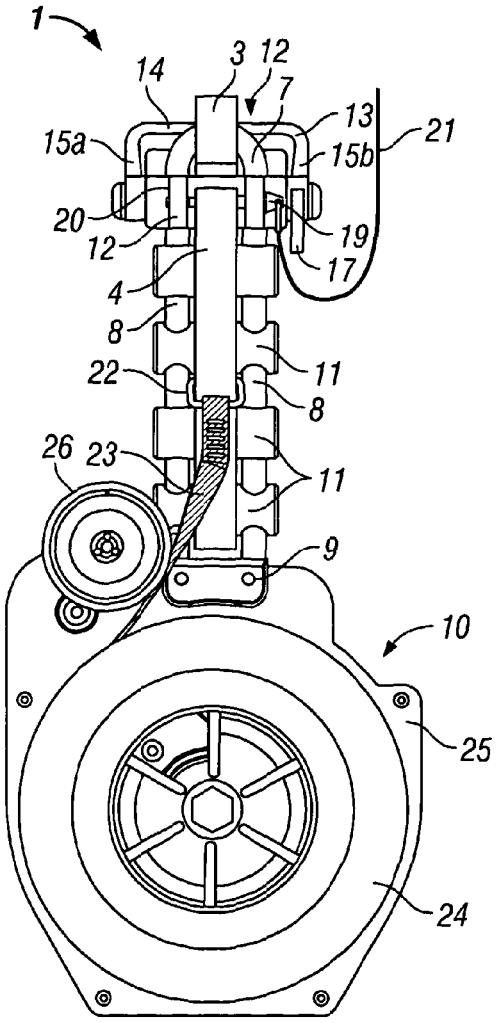
FIGS. 1A and 1B are front and side views, respectively, of a first embodiment of a rescue descender device 1 in accordance with the invention in an initial or first configuration.

Referring to the drawing there is shown a rescue descender device 1 in accordance with the invention. As shown in FIGS. 6A to 6D, the rescue descender device 1 is arranged to be worn on the back of a user mounted to a body harness 30 and be conneted to fall arrest lifeline 36, such as a self retracting lifeline as are known in the art.

The rescue descender device 1 comprises, a first length of binding webbing 2 comprising an upper loop 3, a lower loop 4 and an intermediate webbing length 5 which is stitched together to form a double thickness between the upper and lower loops 3,4. The upper loop 3 of the first length of webbing is arranged to be connected to a fall arrest lifeline such as the self retracting lifeline 36 as are known in the art.

The first length of binding webbing 2 is wrapped, serpentine fashion, around a restraint device 6 which comprises a U shaped frame 7 having spaced limbs 8, at their upper ends joined by a curved crosspiece, and at their lower ends connected to a fixing bracket 9 connected to a descent line store device 10.

A series of movable pinch bars 11 are mounted on the spaced limbs 8 and the first length of binding webbing 2 is wrapped around the movable pinch bars 11 as shown in the FIGS. in serpentine fashion. The movable bars 11 can slide up and own the spaced limbs 8, upward movement being limited by a load arm mounting component 12 that is fixed relative to the U shaped frame 7. The movable pinch bars 11 are provided with respective bores to accommodate the limbs 8. The load arm mounting component 12 carries a pivotally mounted pivoting load arm 13 which has a cross bar 14 and a pair of spaced arms mounting arms 15*a* 15*b*. The pivoting load arm 13 is connected by a webbing loop harness connector 16 to the safety harness (not shown) worn by a user. The webbing loop harness connector 16 is looped around the cross bar 14 of load arm 13.

Figure 1B:
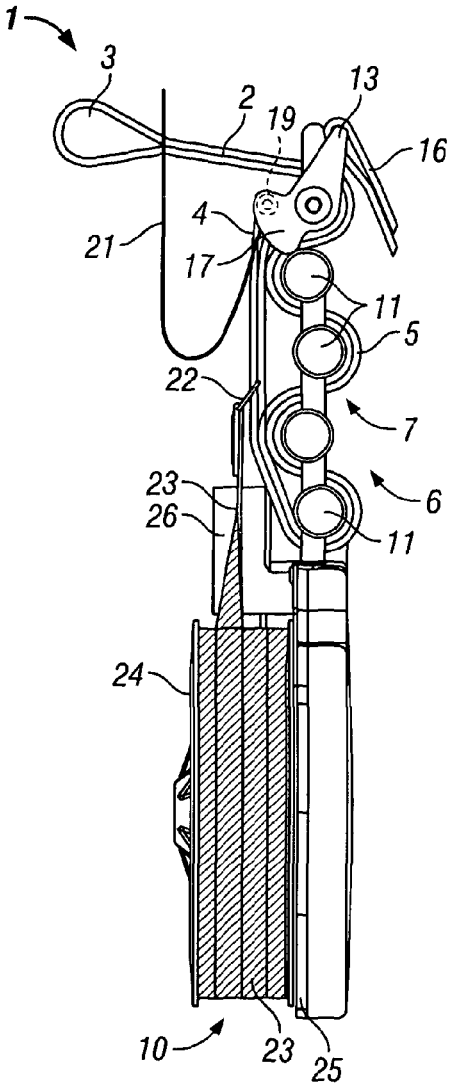
Figure 2:
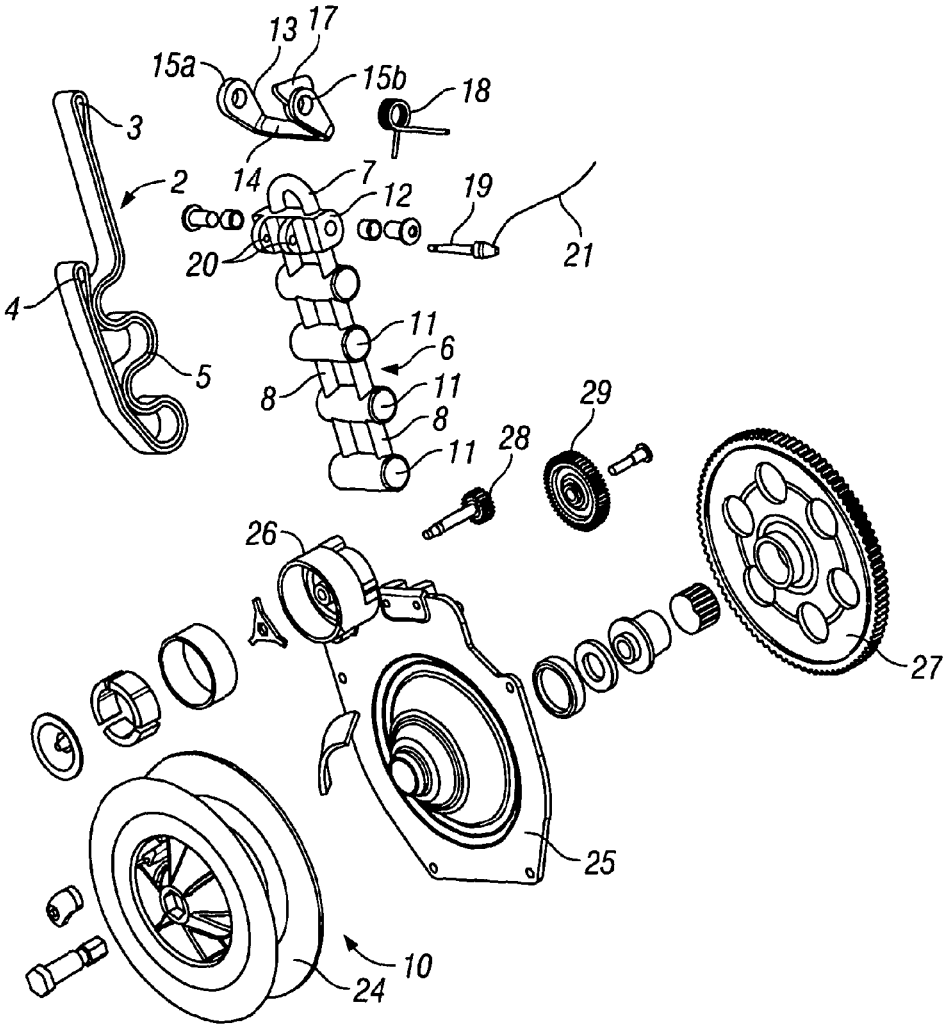
FIG. 2 is a schematic perspective exploded view of the rescue descender device 1 of FIGS. 1A and 1B.

The pivoting load arm 13 is provided with an abutment piece 17 such that when the pivoting load arm 13 is biased to its normal at rest position (as shown in FIGS. 1A and 1B) by the biasing torsion spring 18, the abutment piece 17 is positioned to lie adjacent the head of a release pin 19, which is mounted in respective receiving bores 20 of the mounting component 12. The head of the release pin 19 is connected to an end of a pin release tether 21. The lower loop 4 of the first length of webbing 2 is connected via a connector clasp 22 to a descent line 23. The descent line 23 is fixed at its other end and is wound on a descent line drum 24.

The descent line drum 24 is mounted to a support plate 25. A brake device 26 is also mounted to the support plate 25. The brake device 26 is coupled to rotation of the descent line drum 24, by means of a gear arrangement comprising a main gear 27 which rotates with the brake device 26 and is connected to a brake pinion gear 28 by means of an idler gear 29. As the brake device 26 rotates to deploy the descent line 23, the brake pinion gear 28 is activated by the main gear 27 in order to brake the rotation of the descent line drum 24 and slow deployment of the descent line 23.

As shown in FIGS. 1A and 1B, when the rescue descender device 1 is ready for use, it is in the configuration shown. The webbing loop harness connector 16 is connected to the users harness and the upper loop 3 is connected via the safety line 36 (for example a standard self retracting lifeline) to an anchor point. In this way the user is securely anchored to an anchor point via the rescue descender device 1. In this configuration, the release pin 19 cannot be removed from the receiving bores 20 of the load arm mounting component 12. This is because the abutment piece 17 of the pivoting load arm 13 is positioned adjacent the head of the release pin 19 and prevents removal of the release pin 19. In the embodiment shown the torsion spring 18 biases the pivoting load arm 13 to this 'normal' position, although the shape of the pivoting load arm 13 is such that the pivoting moment normally biases the pivoting load arm 13 to this position under gravity in any case. In this configuration the user can move about their business unhindered, but the release pin 19 cannot be removed either intentionally or un-intentionally.

Figure 3A:
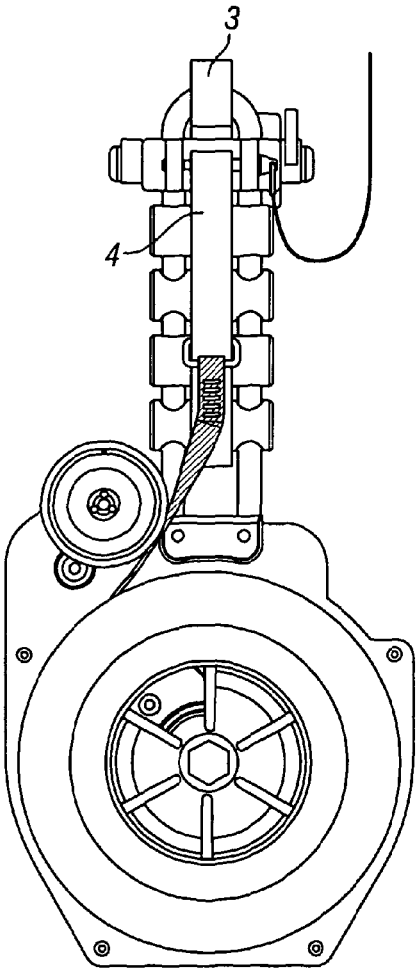
FIGS. 3A and 3B are front and side views, respectively, of the rescue descender device 1 of FIGS. 1A and 1B in an alternative configuration.
Figure 3B:
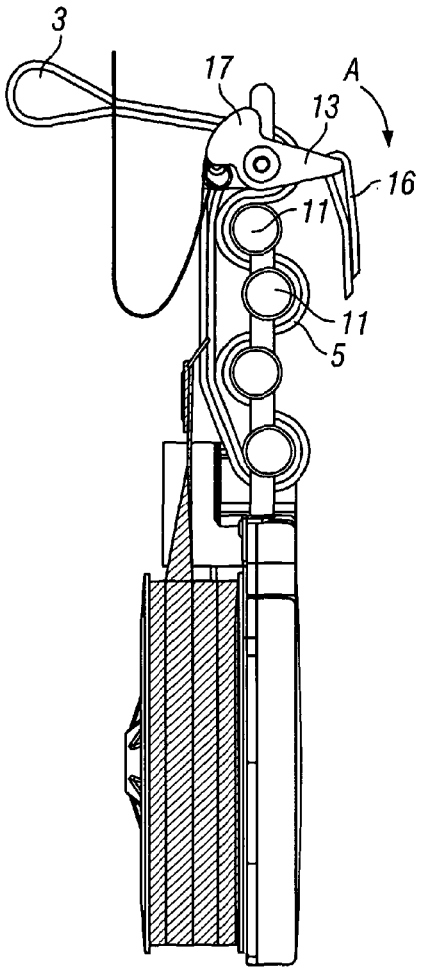
Figure 4A:
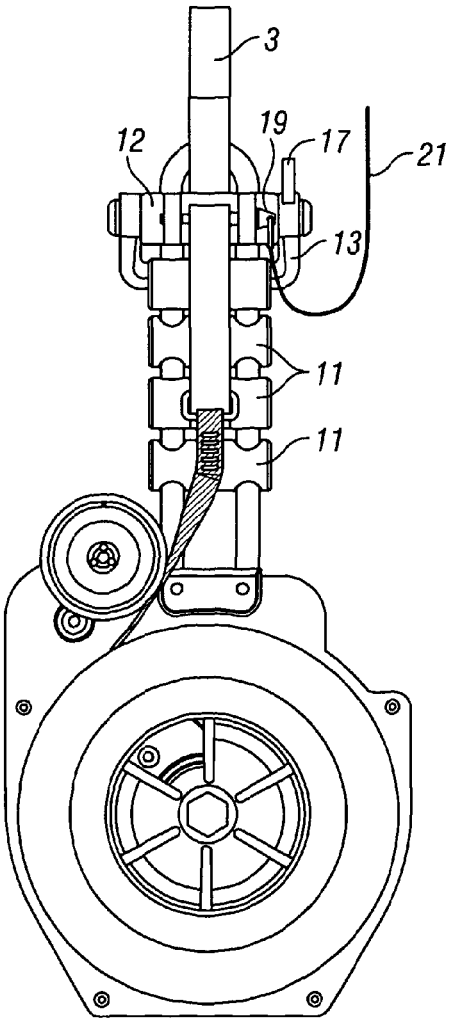
FIGS. 4A and 4B are front and side views, respectively, of the rescue descender device 1 of FIGS. 1A and 1B in a further configuration.
Figure 4B:
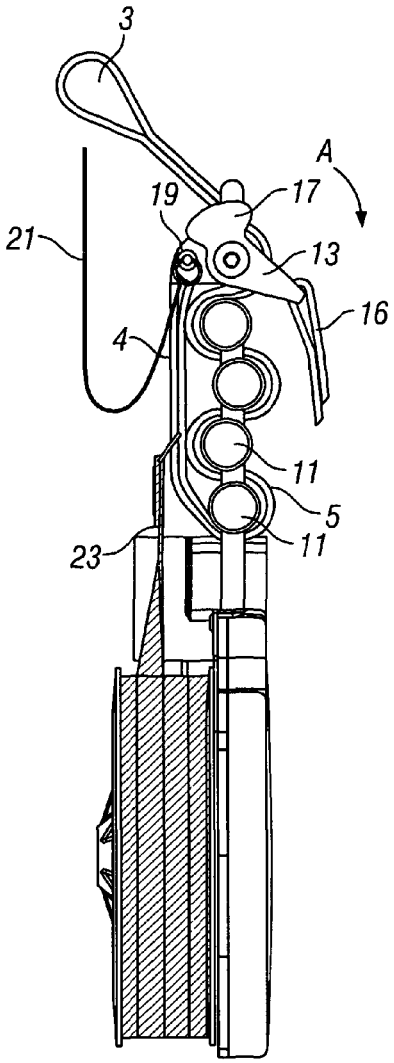

In the event of a fall arrest event, the rescue descender device 1 reconfigures from the position shown in FIGS. 1A and 1B to the position shown in FIGS. 4A and 4B via the intermediate position shown in FIGS. 3A and 3B. As the user becomes suspended from the anchor point via the safety line 36 connected to the upper loop 3 of the first length of the binding webbing 2, the intermediate webbing length 5 pulls up on the series of movable bars 11 causing the movable bars 11 to slide upwardly and pinch the intermediate webbing length 5 securely. This ensures that the intermediate webbing length 5 and the movable bars 11 are held fast. The main upward force acts via the lowermost of the movable bars 11 and the intermediate binding webbing length 5 which is wrapped around the lowermost of the movable bars 11. This configuration is shown in FIGS. 3A and 3B.

Simultaneously, under the weight of the user now suspended from the anchor point, the pivoting load arm 13 pivots downwardly (arrow A). In so doing, the abutment piece 17 of the pivoting load arm 13 pivots out of its blocking position adjacent with the head of release pin 19. Therefore once the fall arrest event occurs and the pivoting load arm 13 is loaded by the user—s suspended weight, the abutment piece 17 moves such that the release pin 19 can be pulled out of the receiving bores 20 of the load arm mounting component 12.

In the embodiment the release pin 19 can only be removed from its home position secured in the receiving bores 20 of the load arm mounting component 12 when the pivoting load arm 13 is moved from its normal position. Furthermore the arrangement ensures that the pivoting load arm 13 moves from its home position automatically as a result of a fall arrest event. The pin release tether 21 is connected to the release pin 19 and has an end accessible to be pulled by the user to enable the release pin 19 to be removed when ready.

Figure 6B:
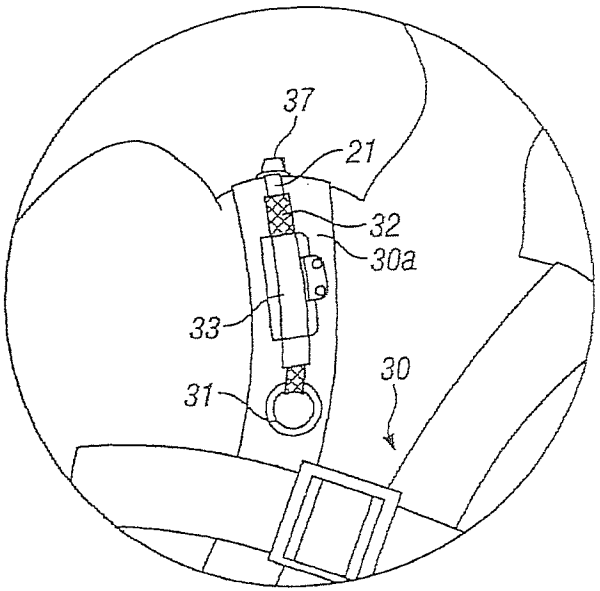
FIGS. 6A, 6B, 6C and 6D are views showing the rescue descender device 1 of FIGS. 1A and 1B mounted to a harness worn by a user.
Figure 6A:
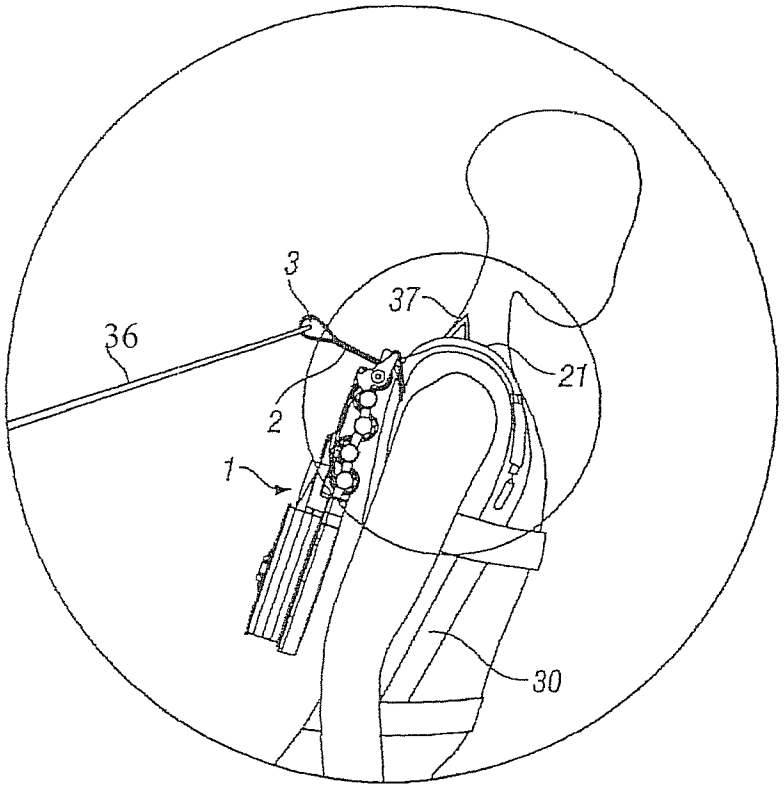
Figure 6C:
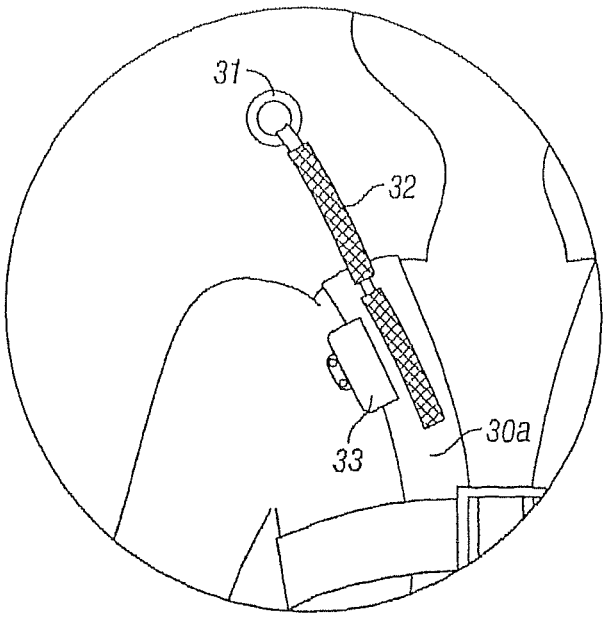
Figure 6D:
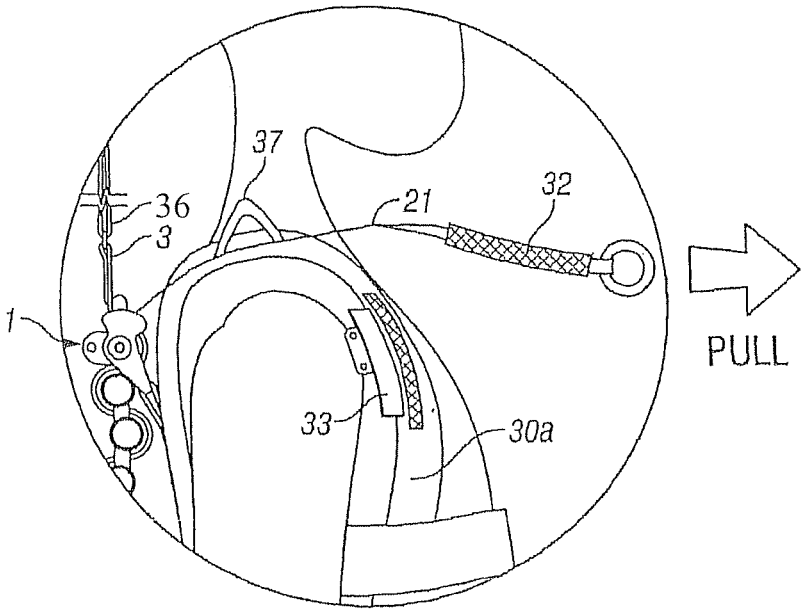
Figure 7C:
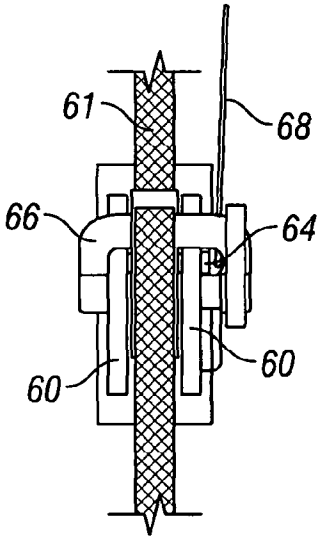
FIGS. 7A, 7B and 7C are opposed side views and a front view, respectively, of an alternative embodiment in accordance with the invention, in a first (line pinching or clamping) configuration.
Figure 7B:
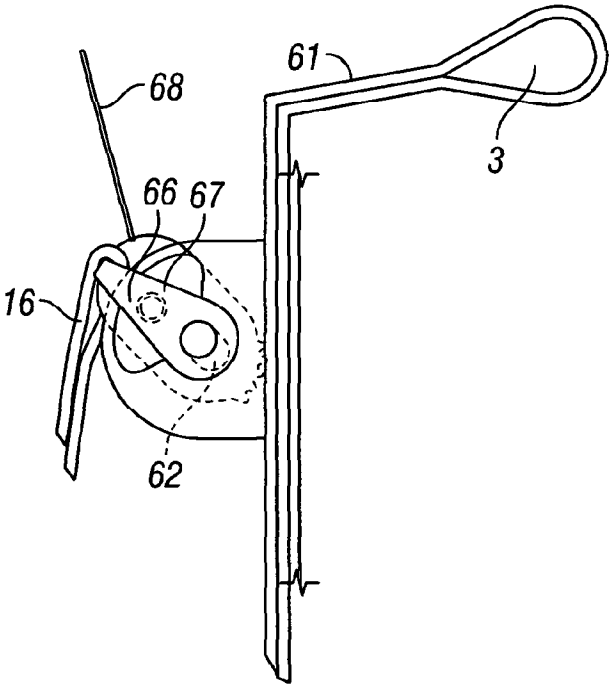
Figure 7A:
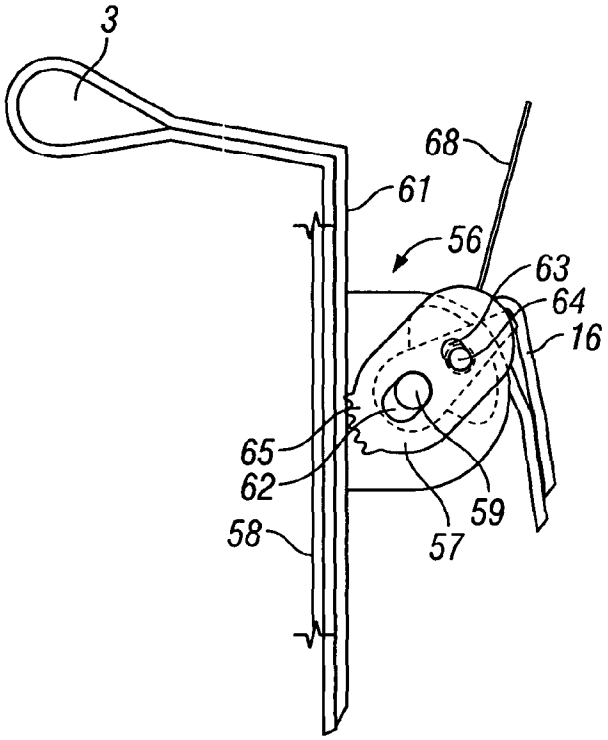

As shown in FIGS. 6A to 6C the release tether 21 can be secured within a pack or enclosure mounted on or with the harness 30 ready for use. In the embodiment shown the release tether is secured to a shoulder strap 30a on the front of the user and a finger grip toggle 31 is connected to the tether line 21 to be pulled by the user in order to release the release pin 19. The tether line 21 is provided with a Velcro type band 32 to secure to the shoulder strap 30*a*. An over cover 33 is provided to prevent accidental release. In a preferred embodiment the tether line 21 can be provided with a second pull formation 37 in addition to the finger pull toggle 31. The second pull formation 37 is a rigid or semi-rigid ring (such as a 'D' ring) secured in position on the tether line 21. The second pull formation 37 is in use positioned to stand proud of, or project from, the shoulder strap of the harness adjacent the shoulder, torso or back of a user. The second pull formation 37 is shown in FIGS. 6A 6B 6D (but omitted from FIG. 6C). In use the second pull formation 37 can be accessed remotely from the user, for example by means of hook rod used from above, in order to pull the release tether line remotely from the user. This enables the user to be lowered using the decent device actuated from a remote position.

Figure 5A:
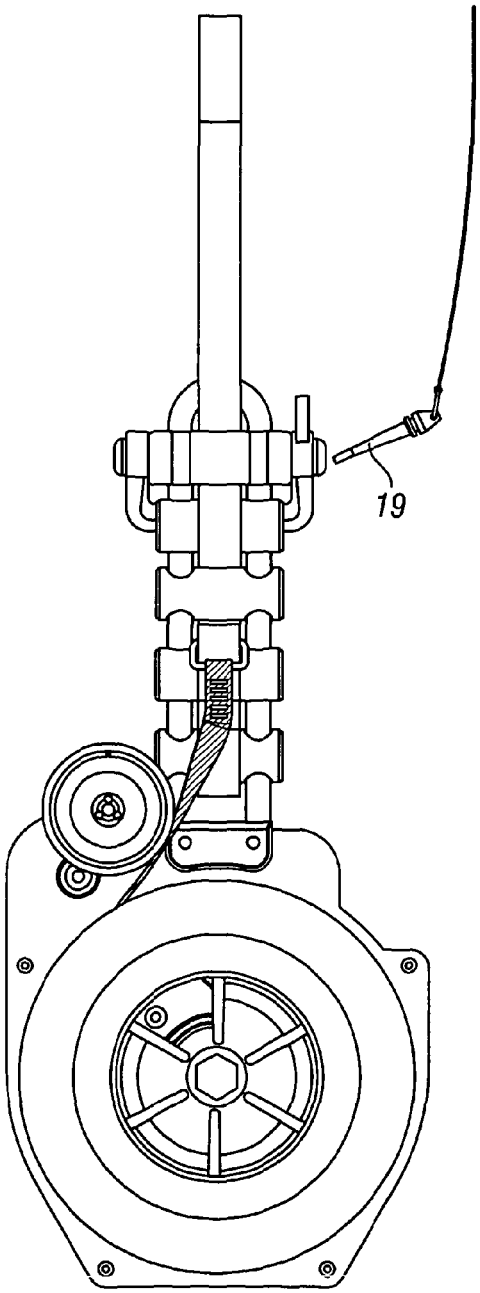
FIGS. 5A and 5B are front and side views, respectively, of the rescue descender device 1 of FIGS. 1A and 1B in a final configuration.
Figure 5B:
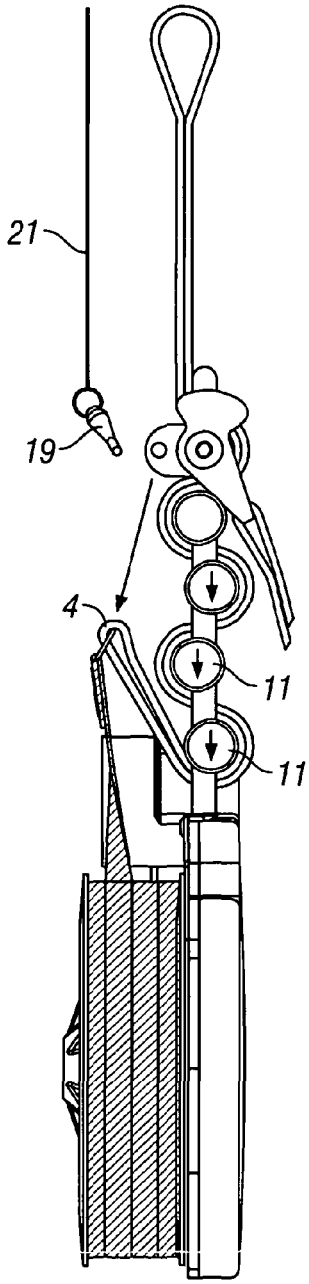

Once the user has fallen and his fall has been arrested, he is suspended by the device 1 which is attached to the harness 30 on the back of the user. As shown in FIGS. 6C and 6D, when the user is ready he opens the over cover 33, peels back the band 32 and pulls on the pin release tether 21 to remove the release pin 19 from its home position. The resultant operation is shown in FIGS. 5A and 5B. The release pin 19 releases from the lower loop 4 of the first length of the binding webbing 2. As a result of releasing the lower loop 4 of the first length of webbing, the lower loop 4 can drop down releasing the tension on the intermediate webbing length 5 wound around the lowermost one of the movable pinch bars 11. As a result the series of movable bars 11 can drop downwardly (see the arrows in FIG. 5B) becoming spaced out on the U shaped frame 7. The intermediate webbing length 5 is no longer bound fast by the movable pinch bars 11 and as a result the intermediate webbing length 5 can feed through the pinch bars 11 in an upward direction of the U shaped frame 7.

The closed end of the lower loop 4 catches on the connector clasp 22 and pulls the connector clasp 22 through the movable bars 11 along a serpentine path in an upward direction of the U shaped frame 7. In so doing the descent line 23 is also pulled from the descent line drum 24 along the same path. As a result loop 2 moves away from the U shaped frame 7, and the U shaped frame 7 and the user attached via the webbing loop harness connector 16 descends relative to the upper loop 2. FIGS. 4A and 4B show the connector clasp 22 pulled completely through the U shaped frame 7 and bars 11 together with the upper end of the connector clasp 22. The brake device 26 acts to slow the rate of descent in accordance with a preset desired descent rate.

In this embodiment, the release pin 19 is not a primary load supporting member of the rack restraint device 6. The main vertical load is taken up by the intermediate webbing length 5 folded under the lowermost pinch bar 11. The length 5 is clamped between the pinch bars 11, such that the downward pulling force exerted by the loop 4 on the pin 19 is negligible when compared with the impulse weight or force as a result of the suspended user.

Accordingly the force required to remove the pin 19 (when the abutment piece 17 is moved clear of the path of the release pin 19) is sufficiently low to enable the user to remove the pin 19 manually by pulling on the release pin tether 21. The pivoting load arm 13 moves automatically as a result of the load applied by the suspended user to clear the abutment piece 17 from obstructing removal of the release pin 19. The load of the suspended user imparted between the length of webbing 2 (connected to the safety line 36) and the descender device is not transmitted primarily via the release pin 19. The load on the release pin 19 is substantially independent of the load imparted by the suspended user.

The first length of webbing 2 is connected to the descent line 23 by the clasp 22. These can be considered effectively as a single line as they act as such when deployed. The webbing 2 is connected to the safety line 36.

Referring now to FIGS. 7A to 9B, there is shown an alternative embodiment of the invention.

In the arrangement shown in FIGS. 7A to 9B the restraint device 6 of the first embodiment having the U shaped frame 7 with the bars 11 movably mounted on the limbs 8 is replaced by a cam action restraint device 56. The cam action restraint device 56 comprises a cam actuator 57 which is mounted to a support plate 58 by means of a pivot pin 59 mounted between limbs 60. A length of descent line 61 extends in the channel defined between the limbs 60 past the position of the pivot pin 59 and the cam actuator 57. The cam actuator 57 has a length of descent line 61 extending radially with respect to an arcuate slot 63. The length of descent line 61 receives the pivot pin 59. The arcuate slot 63 receives the release pin 64. The cam actuator 57 is provided with a serrated grip zone 65 for biting into the length of descent line 61 to clamp the length of descent line 61 fast against the 38.

Figure 8C:
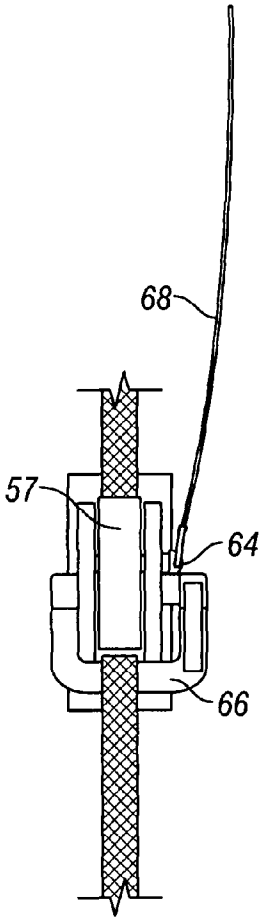
FIGS. 8A 8B and 8C are opposed side views and a front view corresponding to the views of FIGS. 7A, 7B and 7C but in an alternative (line pinching or clamping) configuration.
Figure 8B:
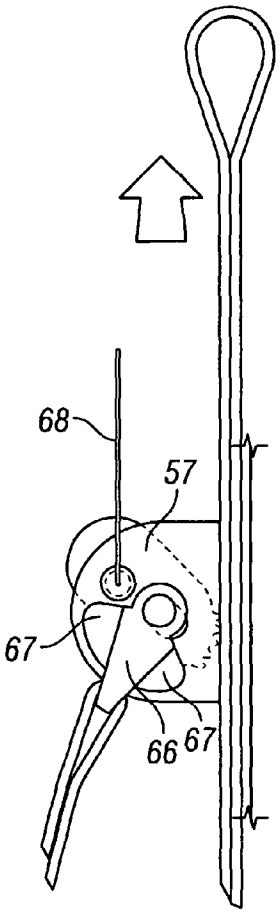
Figure 8A:
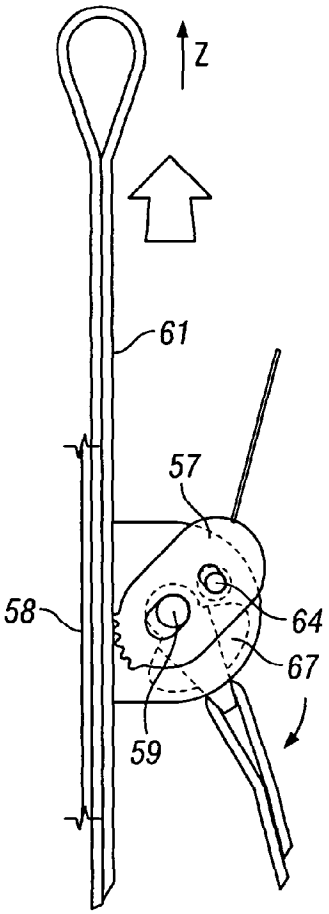

The cam action restraint device 56 is provided with a pivoting load arm 66 corresponding to the pivoting load arm 13 of the first embodiment, which has projecting abutment pieces 67 corresponding to the abutment piece 17 of the first embodiment. The abutment pieces 67 act to prevent removal of the release pin 64 from the arcuate slot 63 until the load is applied to pivot the pivoting load arm 66 as a result of a fall (in a similar means to operation of the first embodiment). The arrangement of this embodiment is set up for use by arranging the cam action restraint device 56 in the configuration shown in FIGS. 7A to 7C. In this position, presence of release pin 64 in the arcuate slot 63 ensures that the cam actuator 57 pivots about the end of the eccentric slot 62 closest to the arcuate slot 63. In so doing when the length of descent line 61 is pulled upwardly by a load, acting in the direction of arrow Z (as shown in FIGS. 8A to 8C), the cam actuator 57 tends to pivot to become increasingly engaged with length of descent line 61, ensuring that the clamping grip against support plate 58 is increased.

The arcuate slot 63 permits pivoting of the cam actuator 57 about the pivot pin 59 to a limited arc. In this way increasing load on the length of descent line 61 results on an increasingly secure grip of length of descent line 61 against support plate 58. In the set up position, the pivoting load arm 66, which is connected to the users harness, is biased to a position in which one of the abutment pieces 67 are positioned adjacent the end of the release pin 64, preventing the release pin 64 from being removed from its position within arcuate slot 63.

Figure 9B:
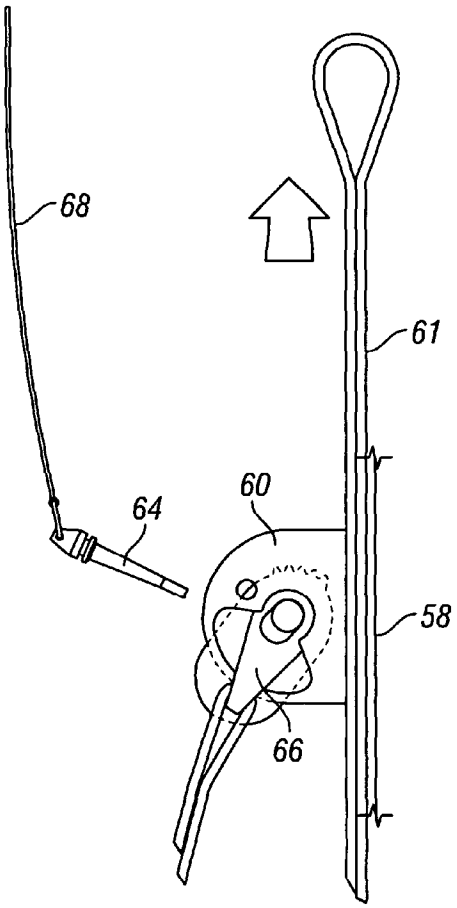
FIGS. 9A and 9B are opposed side views of the arrangement of FIGS. 7A to 8C in a line released configuration.
Figure 9A:
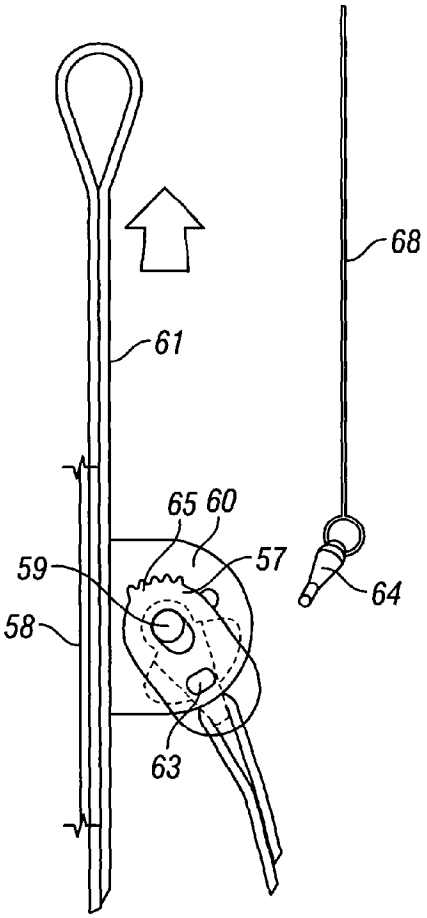
Figure 10:
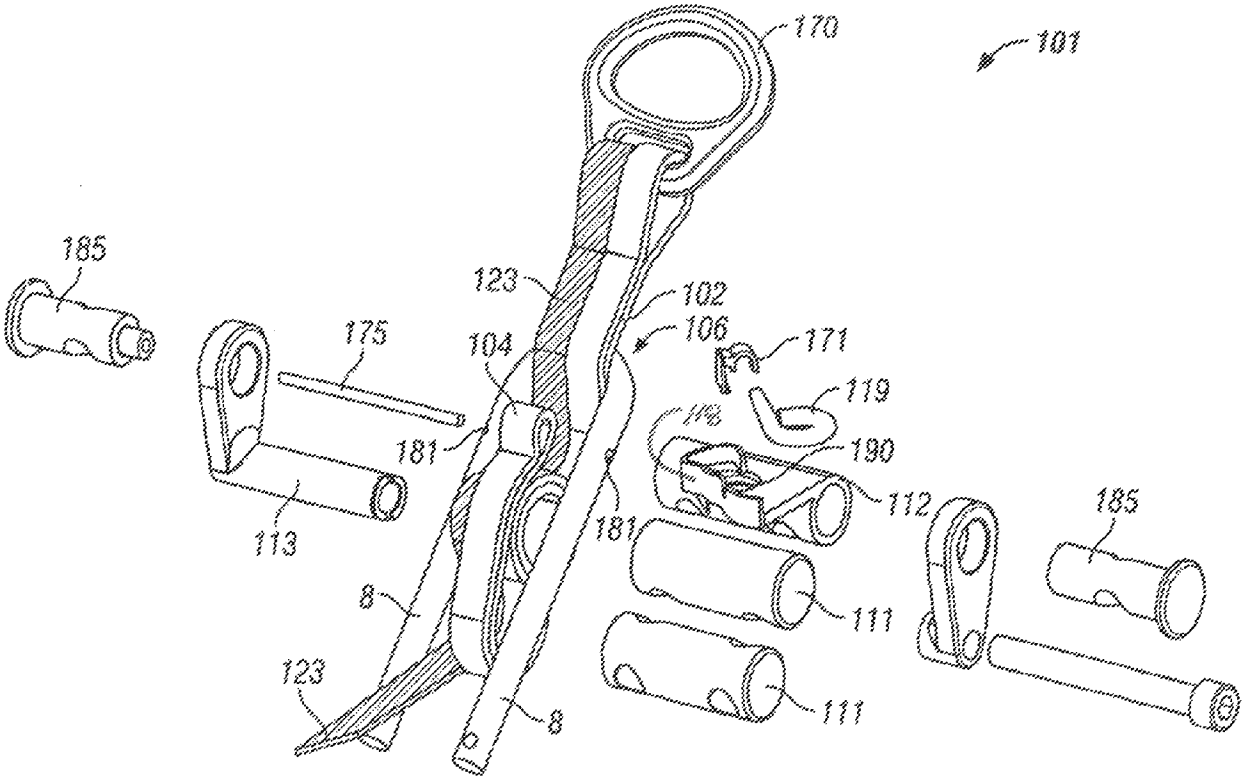
FIG. 10 is a perspective view of the parts making up an alternative embodiment of a descender device according to the invention.

When the user falls and the fall is arrested, the pivoting load arm 66 pivots to a release position under the load applied by the user suspended from the length of descent line 61. This is the position shown in FIGS. 8A to 8C. This happens in a similar manner as for the first embodiment. In so doing, the abutment piece 67 moves clear of the release pin 64 and no longer acts as an obstruction to removal of the release pin 64 from the arcuate slot 63. The user can pull on a release pin tether 68 which is connected to the release pin 64 in order to pull the release pin 64 completely out of the arcuate slot 63. In so doing, cam actuator 57 is able to move away from the length of descent line 61 and the support plate 58 and the clamping grip of the cam actuator 57 against the support plate 58 is released. The eccentric slot 62 moves with respect to the pivot pin 59 from the clamping position shown in FIGS. 7 and 8 to a release position shown in FIGS. 9A and 9B. The cam actuator 57 is free to rotate to the release position as shown in FIGS. 9A and 9B. In this position, the length of descent line 61 can pas through the cam action restraint device 56.

The length of descent line 61 can extend completely through the device and be connected at an upper end to the safety line and wound below the cam action restraint device 56 onto a storage reel (such as the reel 24). Up-line and down-line of the cam action restraint device 56, the descender device can be in accordance with the first described embodiment. Accordingly when the cam action restraint device 56 has been released to the configuration of FIGS. 9A and 9B, the length of descent line 61 can be wound from the descent line drum 24 along the path through the cam action restraint device 56. The brake device 26 acts to slow the rate of descent in accordance with a preset desired descent rate.

In this embodiment, the release pin 64 is not a load supporting member of the cam action restraint device 56 and accordingly the force to remove the pin 64 (when the abutment piece 67 is moved clear of engagement with the release pin 64) is sufficiently low to enable the user to remove the pin 64 manually by pulling on the release pin tether 68. The pivoting load arm 66 moves automatically as a result of the load applied by the suspended user to clear the abutment piece 67 from obstructing removal of the release pin 64. The load of the suspended user imparted between the length of descent line 61 and the descender device 56 is not transmitted primarily via the release pin 64. The load on the release pin 64 is independent of the load imparted by the suspended user.

Referring now to FIGS. 10 to 13B, there is shown a further embodiment of a descender device 101, which is similar in general terms to the device 1 of FIGS. 1 to 5. In this embodiment a restraint rack device 106 has a U shaped frame comprising spaced limbs 108 and two pinch bars 111 which are slidably mounted on the limbs 108. The main difference of this embodiment over the first described embodiment is in relation to the connection between the binding webbing 102 and the descent line 123.

In the previously described embodiment the lower loop 4 of the binding webbing 2 was secured to the upper end of the descent line 23 by means of the clasp 22. This requires the clasp 22 to be pulled through the bars 11 when the descent line is being deployed. In practice the clasp can foul or become trapped resulting in non-ideal deployment or even malfunction.

In the embodiment of FIGS. 10 to 13B, the binding webbing 102 and the release line are connected at a D ring 170 which is positioned downstream of the restraint rack device 106 and which therefore does not need to be pulled through the rack during deployment of the release line 123. The upper portion of the release line 123 is threaded serpentine fashion through the pinch bars 111. The binding webbing is likewise threaded serpentine fashion through the pinch bars 111 and the lower loop 104 is secured about a release pin 119 which is secured in a cradle 118 provided on a platform 112 by means of a breakable clip 171. The platform 112 is provided with mounting apertures top enable mounting on the limbs 8 and is secured in position the rack frame device limbs 108 by means of a pin 175 passing through bores 181, and also the mating plugs 185. The swing arm 113 is pivotally mounted on the plugs 185 and provides for securing to the users harness.

Figure 11B:
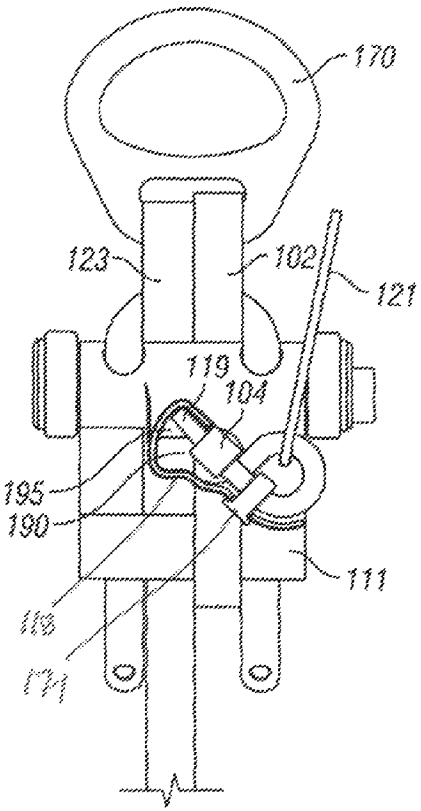
FIGS. 11A and 11B are side and front views, respectively, of the embodiment of FIG. 10.
Figure 11A:
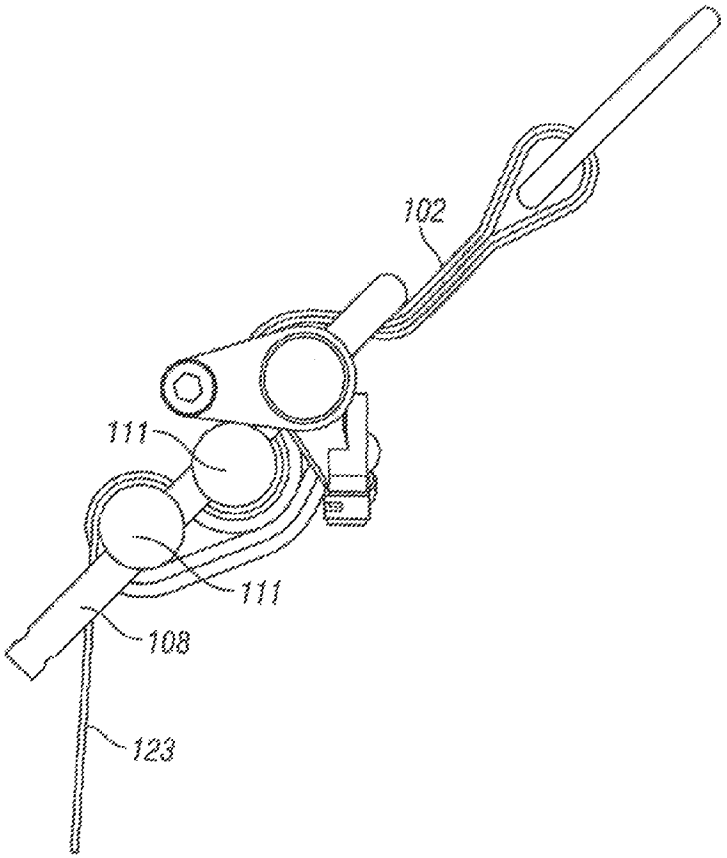
Figure 12:
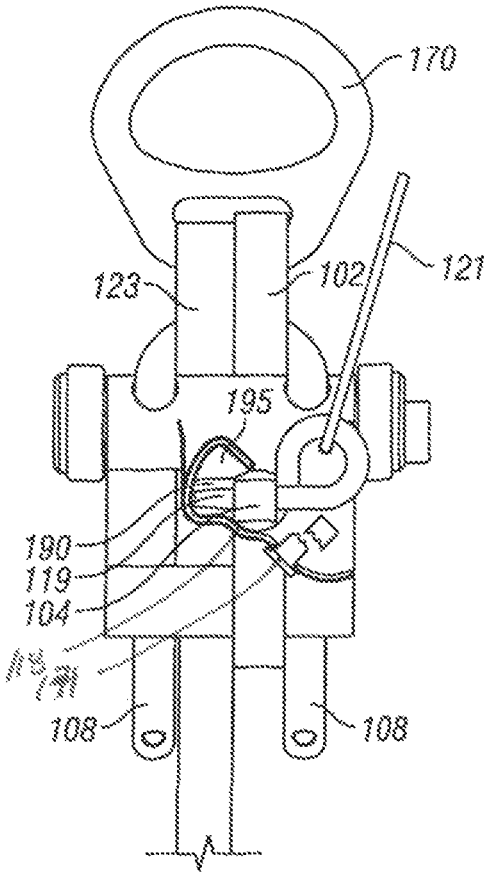
FIG. 12 is a front view of the embodiment of FIG. 10 in an alternative configuration.
Figure 13B:
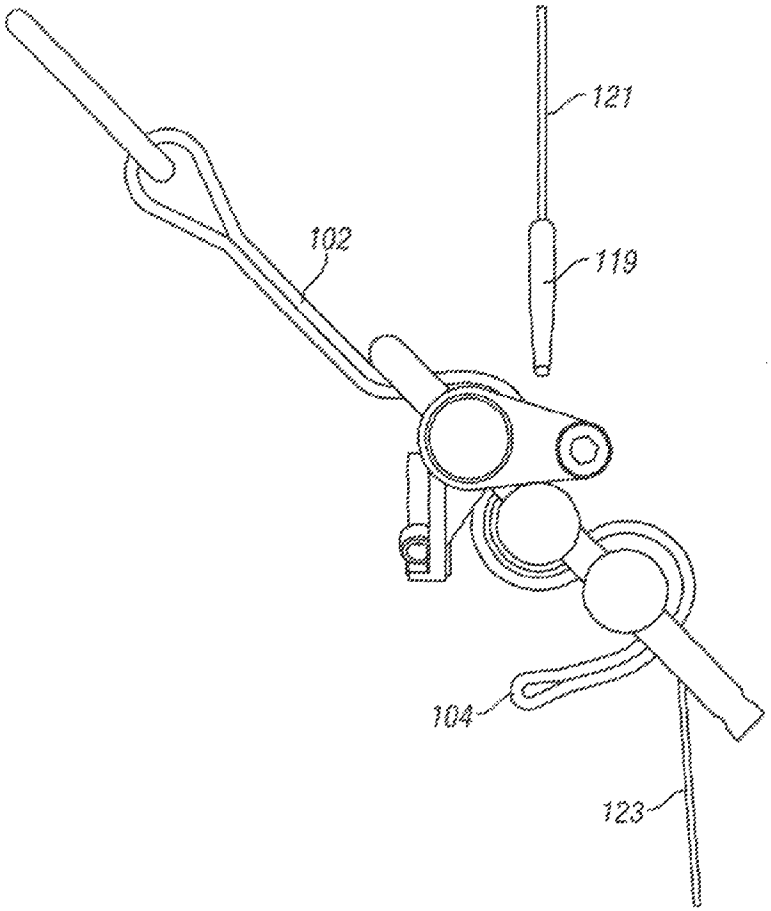
FIGS. 13A and 13B are side and front views, respectively, of the embodiment of FIG. 10 in an alternative configuration.
Figure 13A:
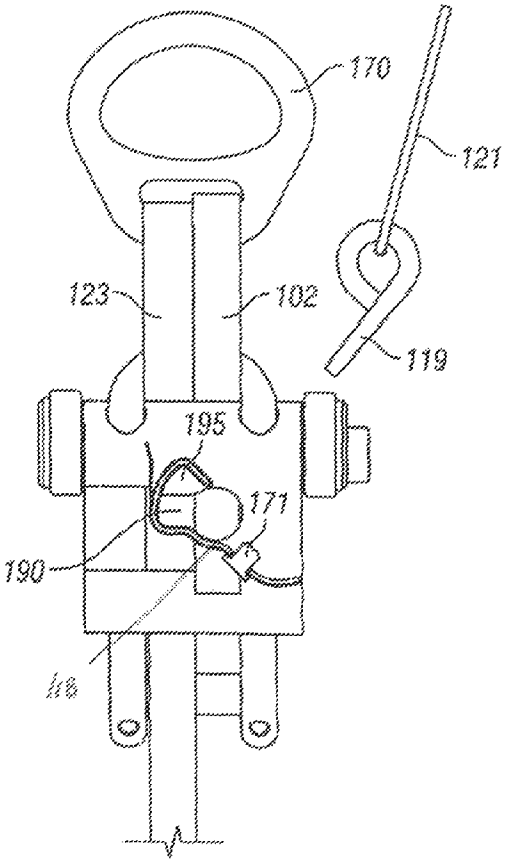

As shown most clearly in FIG. 11B, the release pin 119 is secured by the breakable clip 171 in a specific orientation in the cradle 118. When the device is loaded as a result of a fall arrest event, the binding webbing 102 is pulled tight resulting in the pinch bars 111 being pulled upwardly towards the top of the rack device 106. The release line 123 is pinched by the pinch bars preventing the release line 123 from being pulled through the device. In the loaded condition, the loop 104 of the binding webbing 102 is secured over the release pin 119. The webbing 102 extends downwardly from the pin 119 via an opening 190 in the cradle 118. Therefore in the loaded condition, the tension in the webbing 102 tends to securely hold the release pin 119 in the cradle. The end of the pin 119 rests on a ledge 195 adjacent the opening 190. When the user is suspended and wishes to deploy the release line 123, the user tugs sharply on the release pin tether 121. In doing so the release pin ruptures the clip 171 and pivots from the position shown in FIG. 10B to the position shown in FIG. 1lB. In the position shown in FIG. 12 the end of the release pin 119 is no longer supported on the ledge 195 and the downward force acting on the pin by means of the loop 104 causes the loop 104 to be pulled downwardly off the end of pin 119 and through the opening 190. In so doing the binding action exerted by the binding webbing 102 on the pinch bars 111 is released and they are able to move apart on the limbs 108. This enables the binding webbing 102 and the release line 123 to be drawn simultaneously through the pinch bars 111. This situation is shown in FIGS. 13A and 13B.

Figure 14C:
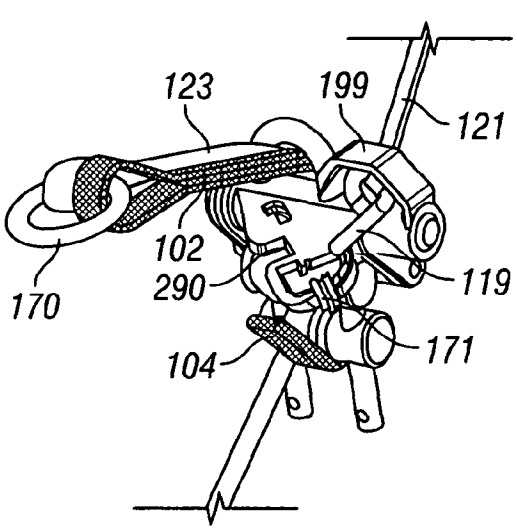
FIGS. 14A, 14B and 14C are perspective views of a further embodiment of the invention in various sequential stages of operation.
Figure 14B:
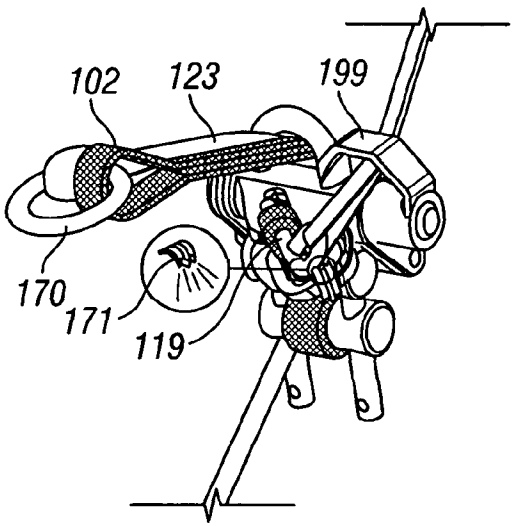
Figure 14A:
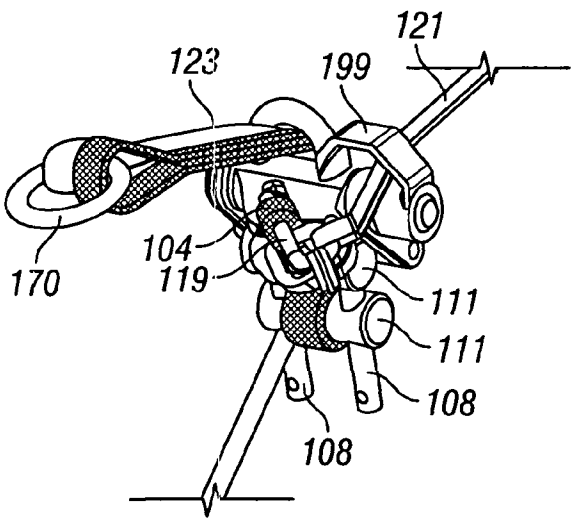

A variation on this theme is shown in the embodiment of FIGS. 14A to 14C, in which like items are referred to with the same reference numbers as the previous embodiment of FIGS. 10 to 13B. In this embodiment the opening 190 is replaced by a slot 290 downwardly through which the end loop 104 of the binding webbing 102 is pulled when the release pin breaks free from the clip 171. A guide frame 199 is provided for the release pin tether 121 in order to ensure that the release pin is pulled from the correct direction to effect release.

The invention claimed is:

1. A descender device for enabling a suspended body to be lowered, the descender device comprising:

a descent line;

a release element to be actuated by a person, the release element arranged in a restraint configuration to inhibit the descent line from being deployed and in a release configuration to permit the descent line to be deployed;

a binding line secured to the release element in the restraint configuration to inhibit the descent line from being deployed and released from the release element in the release configuration in order to permit the descent line to be deployed; and a restraint arrangement arranged prior to deployment of the descent line, to clamp or pinch a length of the binding line to inhibit deployment of the descent line, the restraint arrangement being reconfigurable upon release of the release element to permit the descent line to be deployed, wherein the binding line and the descent line are configured to both extend through the restraint arrangement before deployment of the descent line.

2. A descender device according to claim 1, wherein:

the release element is connected to a pull tether that extends over a shoulder portion of a harness.

3. A descender device according to claim 1, wherein:

the release element is coupled to a flexible line by a loop or ring.

4. A descender device according to claim 3, wherein:

the release element comprises a pin extending through the loop or ring, the loop or ring being pulled off over the end of the pin when moving to the release configuration.

5. A descender according to claim 1, wherein:

the release element is connected to a pull tether, which pull tether has a finger pull portion to be gripped by a user, and in addition to the finger pull portion, a second pull formation.

6. A descender according to claim 5, wherein:

the second pull formation is in use positioned adjacent the shoulder, torso or back of a user.

7. A descender according to claim 5, wherein:

the second pull formation comprises a loop or ring secured with respect to the pull tether and arranged to stand proud of the user when the device is mounted to the user.

8. A descender device according to claim 1, wherein:

the restraint arrangement comprises a clamp arrangement which is arranged to clamp or pinch a portion of the binding line.

9. A descender device according to claim 8, wherein:

the clamp arrangement is configured to clamp or pinch the binding line at one or more points intermediate the opposed ends of the binding line and spaced from the release element.

10. A descender device according to claim 1, wherein:

the release element is configured such that moving of the release element to the release configuration permits or causes the restraint arrangement to reconfigure from the clamping position, to permit the binding line to pass.

11. A descender device according to claim 1, wherein:

the restraint arrangement comprises a plurality of bars or elements spaced on a rack with the binding line configured to pass serpentine-wise through the bars or elements.

12. A descender device according to claim 11, wherein:

the bars or elements are configured such that the spacing of the bars or elements on the rack reduce in size, in order to clamp the binding line between the bars or elements, and expand in size, to permit the binding line to pass via the bars or elements.

13. A descender device according to claim 11, wherein:

the release element is configured such that moving of the release element to the release configuration permits or causes the spacing between the bars or elements to increase in size in order to permit the binding line to pass via the bars or elements.

14. A descender device according to claim 1, wherein:

the descent line and the binding line are arranged to be drawn through the clamping arrangement in unison in a side by side manner when the descent line is deployed.

15. A descender device according to claim 1, wherein:

the binding line and the descent line are connected to one at a position downstream deployment-wise of the clamping arrangement.

16. A descender system according to claim 1, wherein:

the release element means comprises a pin.

17. A descender device according to claim 1, wherein:

the release element is configured such that, when actuated to permit the descent line to be deployed, the release element is forced to rupture or break a capture element securing the release element in the restraint configuration.

18. A descender device according to claim 1, wherein:

the descent line is stored on-board the descender device.

19. A descender device according to claim 1, wherein:

the descent line is wound on a reel pending deployment.

20. A descender device according to claim 1, further comprising:

a brake arrangement configured to limit the deployment rate of the descender line.

21. A personnel safety harness incorporating a descender device according to claim 1.

22. A fall arrest system incorporating a descender device according to claim 1.

* * * * *